US006172653B1

(12) United States Patent
Ohnishi et al.

(10) Patent No.: US 6,172,653 B1
(45) Date of Patent: Jan. 9, 2001

(54) MOBILE SATELLITE COMMUNICATION ANTENNA

(75) Inventors: Tadaaki Ohnishi; Tomoki Ikeda, both of Fukushima-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/299,942

(22) Filed: Apr. 26, 1999

(30) Foreign Application Priority Data

Apr. 27, 1998 (JP) ..... 10-116322

(51) Int. Cl.[7] ..... H01Q 3/00
(52) U.S. Cl. ..... 343/882; 343/766; 343/757
(58) Field of Search ..... 343/882, 878, 343/757

(56) References Cited

U.S. PATENT DOCUMENTS 5,982,333 * 8/1997 Stillinger et al. ..... 343/766

FOREIGN PATENT DOCUMENTS 8-78936 3/1996 (JP) .

* cited by examiner

*Primary Examiner*—Don Wong
*Assistant Examiner*—James Clinger
(74) *Attorney, Agent, or Firm*—Brinks, Hofer, Gilson & Lione

(57) ABSTRACT

Since the mobile satellite communication antenna according to the present invention has the antenna board provided on the top surface of the rotary member in the state in which a part of the antenna board protrudes outward in the radial direction from the outer periphery of the rotary member, the antenna board doubles as a member for preventing the belt from coming off and reduces the number of parts, which can provide an antenna which is inexpensive and compact and is easily assembled.

6 Claims, 3 Drawing Sheets

MOBILE SATELLITE COMMUNICATION ANTENNA

BACKGROUND OF THE INVENTION

1. Field of the Invention

The present invention relates to a mobile satellite communication antenna suitable for a satellite communication and for receiving a satellite broadcasting by a mobile like a car and the like.

2. Description of Related Art

A conventional mobile satellite communication antenna, as shown in FIG. 4 to FIG. 6, comprises a flat main plate 51 and an auxiliary plate 52, and the main plate 51 and the auxiliary plate 52 overlap one another and are combined with screws 3.

The plate 51 is provided with a motor 55 provided with a gear 54 and a converter 57 having a probe 56.

Further, as shown in FIG. 6, a shaft 58 fixed to the auxiliary plate 52 is rotatably mounted with a pulley 59 having a groove 59*a* and a plurality of pulleys 59 having the constitution like this are arranged concentrically with respect to the center part of the main plate 51.

Further, a ring-shaped rotary member 60 comprising a formed product made of synthetic resin has a trapezoidal groove 60*a* having a gear part (not shown) on the whole outer periphery thereof, a ring-shaped protruding part 60*b* made on the lower part of the groove 60*a,* and a hole 60*c* made in the center part thereof.

Further, although not shown here, a plurality of antenna elements are formed concentrically on a disc-shaped antenna board 61, and the antenna board 61 is arranged on the top surface of the rotary member 60 in such a way that it closes the hole 60*c* and is fixed to the rotary member 60 with screws 62.

Further, a ring-shaped preventing member 63 made of a metal plate is arranged on the top surface of the rotary member 60 such that it is positioned outside the antenna board 61, and is fixed to the rotary member 60 with screws 64. When the preventing member 63 is fixed, a part of the preventing member 63 protrudes outward in the radial direction from the outer periphery of the rotary member 60.

An antenna board member 65 is composed of the rotary member 60, the antenna board 11 and the preventing member 63 and is rotatably supported by the pulley 59 with the ring-shaped protruding part 60*b* of the rotary member 60 retained by the grooves 59*a* of the plurality of pulleys 59.

In this respect, the center part of the antenna board 61 is in the state opposite to the probe 56 and supplies radio waves from the antenna elements to the probe 56.

Further, a toothed endless belt 66 is looped around the groove 60*a* having a gear part of the rotary member 60 and the gear mounted on the motor 55, and the antenna board member 65 is rotated by the motor 55 via the belt 66.

In this connection, the top end of the belt 66 looped around the groove 60*a* of the rotary member 60 is prevented from coming off by the preventing member 63 protruding outward in the radial direction from the rotary member 60.

Further, a lever 68 is mounted on the plate 52 such that it can be turned around a shaft 67, and a pulley 69 is rotatably mounted on the lever 68. A spring 70 is interposed between the lever 68 and the plate 52.

The pulley 69 is brought into contact with the outer side of the belt 66 and is pulled by the spring 70 via the lever 68 to eliminate the looseness of the belt 66.

The mobile satellite communication antenna having the constitution described above is mounted on the roof of a mobile like a car and the like, and the antenna board member 65 is rotated by the motor 55 with the movement of the mobile to adjust the orientation to a geostationary satellite.

In the conventional mobile satellite communication antenna, since the antenna board 61 and the preventing member 63 for preventing the belt 66 from coming off are attached to the rotary member 60, the number of parts are increased and the costs increases. Further, a space in which the preventing member 63 is mounted is needed, whereby the size becomes large.

Further, since the rotary member 60 is made of synthetic resin, the expansion and shrinkage of the rotary member 60 caused by a change in environmental temperature outdoors is extremely large, which produces another problem that the antenna board member 65 can not be smoothly rotated and is finally put out of rotation.

SUMMARY OF THE INVENTION

To solve the above-mentioned problems, the present invention provides, as the first solving means, a mobile satellite communication antenna comprising a rotary antenna board member including an antenna board having a plurality of antenna elements and a rotary member provided with the antenna board, a flat plate for holding the antenna board member rotatably, and a belt for rotating the antenna board member, wherein the belt is looped around a groove provided in the rotary member and the antenna board is mounted on the top surface of the rotary member in the state where a part of the antenna board protrudes outward in the radial direction from the outer periphery of the rotary member.

The present invention provides, as the second solving means, the rotary member formed of aluminum die casting.

DETAILED DESCRIPTION OF THE PREFERRED EMBODIMENTS

Figure 1:
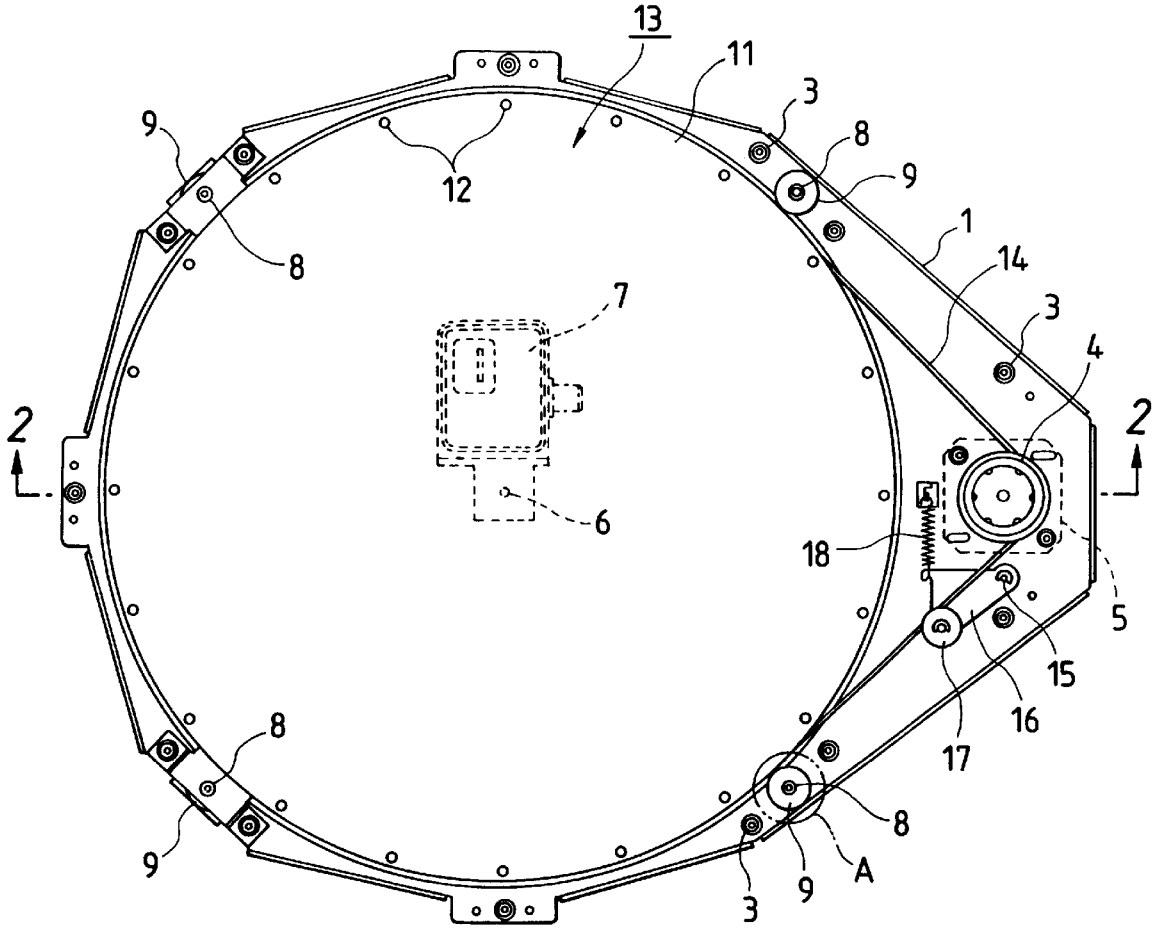
FIG. 1 is a plan view of a mobile satellite communication antenna in accordance with the present invention.
Figure 2:
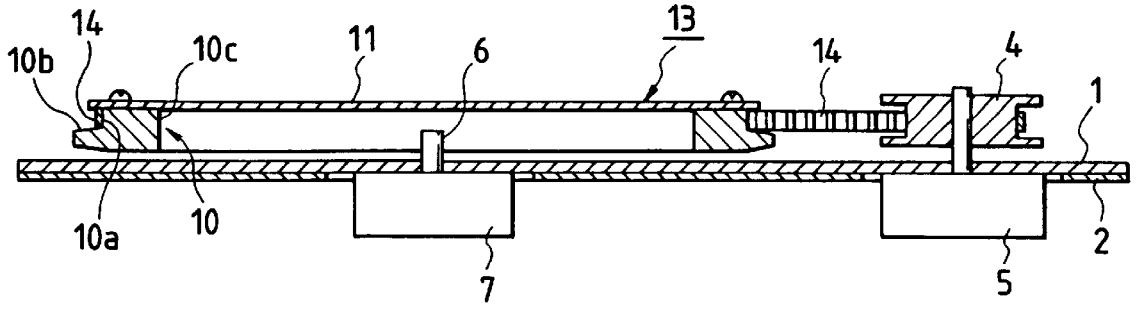
FIG. 2 is a cross-sectional view taken on a line 2—2 in FIG. 1.
Figure 3:
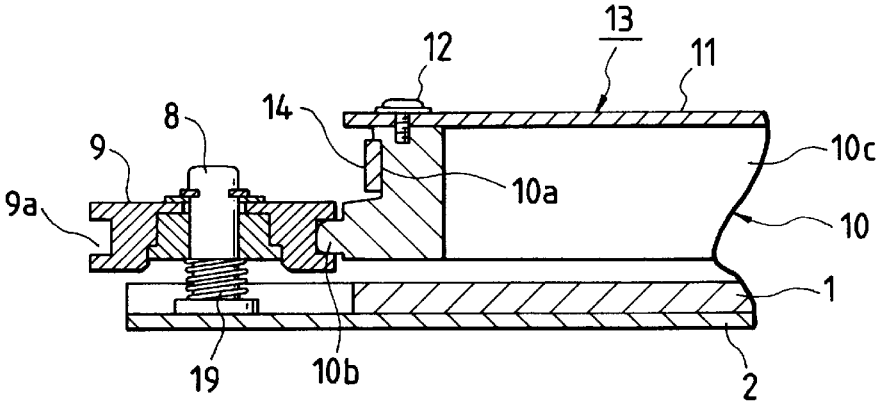
FIG. 3 is a cross-sectional view of the essential part of a part A in FIG. 1.
Figure 4:
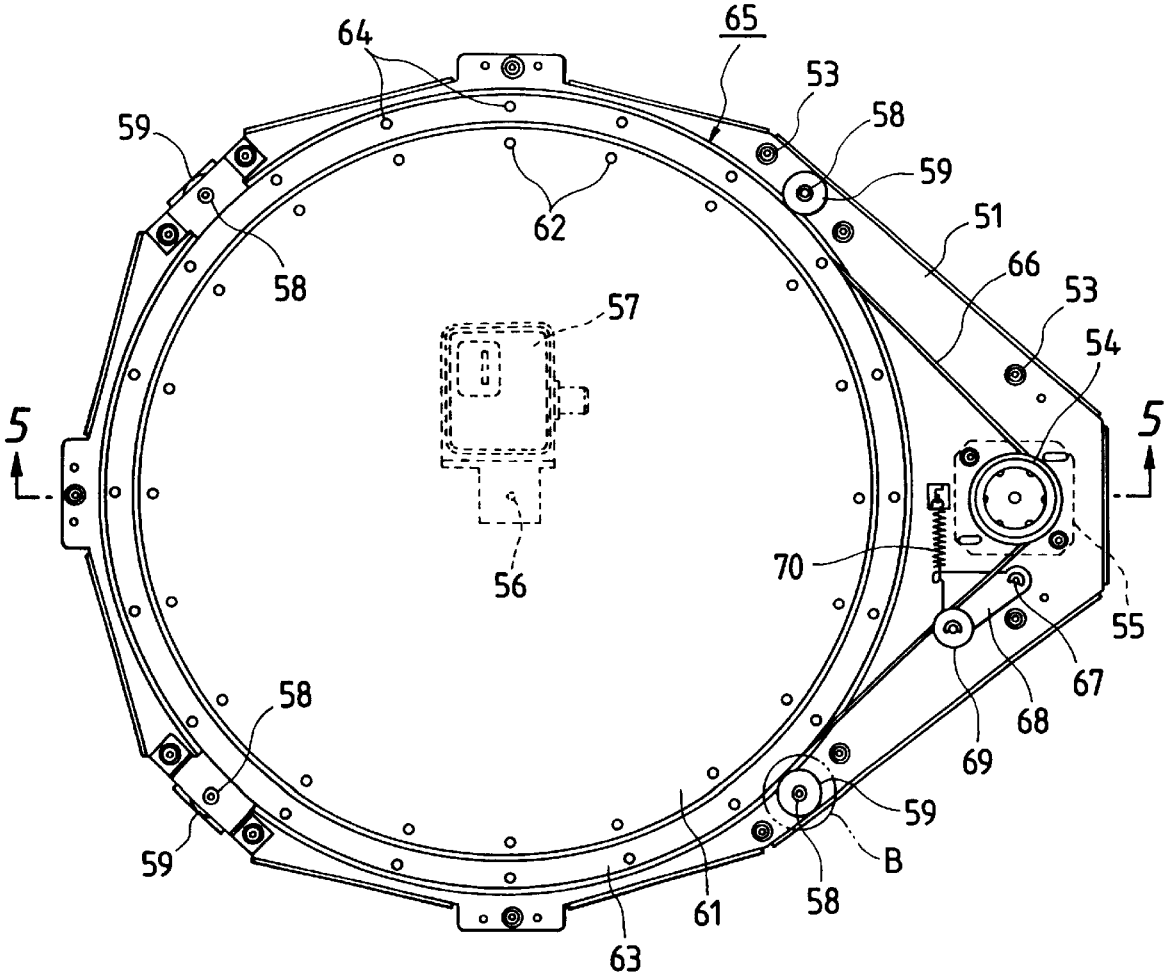
FIG. 4 PRIOR ART
FIG. 4 is a plan view of a conventional mobile satellite communication antenna.
Figure 5:
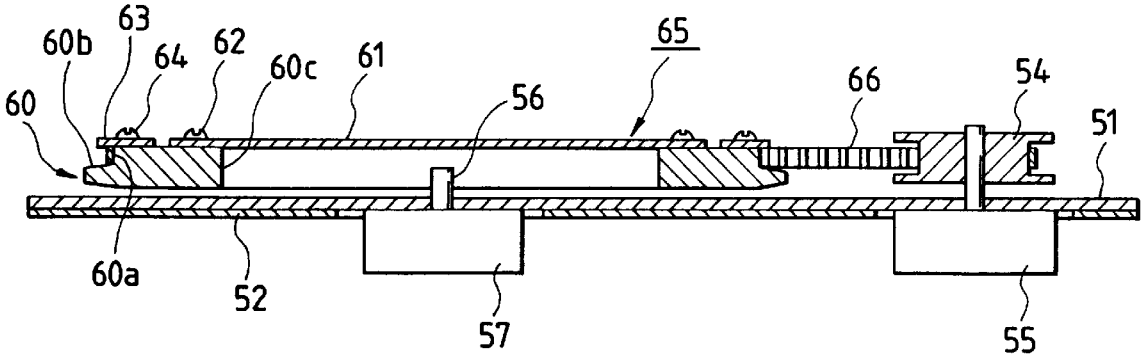
FIG. 5 PRIOR ART
FIG. 5 is a cross-sectional view taken on a line 5—5 in FIG. 4.
Figure 6:
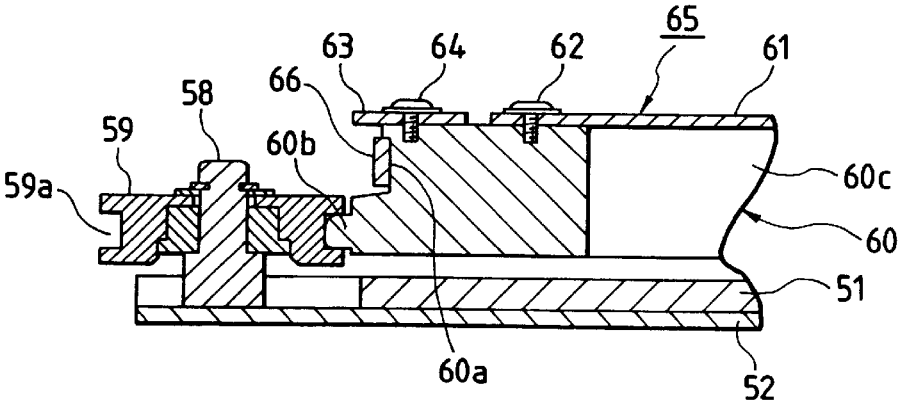
FIG. 6 PRIOR ART
FIG. 6 is a cross-sectional view of the essential part of a part B in FIG. 4.

Describing a mobile satellite communication antenna in accordance with the present invention with reference to FIG. 1 to FIG. 3, FIG. 1 is a plan view of a mobile satellite communication antenna in accordance with the present invention, and FIG. 2 is a cross-sectional view taken on a line 2—2 in FIG. 1, and FIG. 3 is a cross-sectional view of the essential part of a part A in FIG. 1.

The mobile satellite communication antenna in accordance with the present invention, as shown in FIG. 1 to FIG. 3, comprises a flat main plate 1 having a relatively large thickness and an auxiliary plate 2 having a relatively small thickness, the main plate 1 and the auxiliary plate 2 overlapping one another and being combined with screws 3.

A motor 5 provided with a gear 4 and a converter 7 having a probe 6 are mounted on the bottom surface of the plate 1.

As shown in FIG. 3, a pulley 9 having a groove 9*a* is rotatably mounted on a shaft 8 fixed to the auxiliary plate 2 and a plurality of pulleys 9 having the constitution like this are arranged concentrically with respect to the center part of the main plate 1.

Further, the shaft 8 is provided with a coil-shaped spring 19, and the pulley 9 can be moved up and down by the spring 19.

Further, a ring-shaped rotary member 10 made of aluminum die casting has a trapezoidal groove 10*a* provided with a gear part (not shown) on the whole outer periphery, a ring-shaped protruding part 10*b* formed on the lower part of the groove 10*a,* and a hole 10*c* formed in the center part.

Further, although not shown here, a plurality of antenna elements are formed concentrically on a disc-shaped antenna board 11, and the antenna board 11 is arranged on the top surface of the rotary member 10 in such a way that it closes the hole 10*c* and that a part of the antenna board 11 protrudes outward in the radial direction from the outer periphery of the rotary member 10, and the antenna board 11 is fixed to the rotary member 10 with screws 12.

An antenna board member 13 is composed of the rotary member 10 and the antenna board 11 and is rotatably supported by the pulley 9 with the ring-shaped protruding part 10*b* of the rotary member 10 retained by the grooves 9*a* of the plurality of pulleys 9.

In this respect, the center part of the antenna board 11 is in the state opposite to a probe 6 and supplies radio waves from the antenna elements to the probe 6.

Further, a toothed endless belt 14 is looped around the groove 10*a* having the gear part of the rotary member 10 and a gear mounted on a motor 5, and the antenna board member 13 is rotated by the motor 5 via the belt 14.

In this connection, the top end of the belt 14 looped around the groove 10*a* of the rotary member 10 is prevented from coming off by a part of the antenna board 11 protruding outward in the radial direction from the rotary member 10.

Further, a lever 16 is mounted on the plate 2 such that it can be turned around a shaft 15 and a pulley 17 is rotatably mounted on the lever 16 and a spring 18 is interposed between the lever 16 and the plate 2.

The pulley 17 is brought into contact with the outer side of the belt 14 and is pulled by the spring 18 via the lever 16 to eliminate the looseness of the belt 14.

The mobile satellite communication antenna having the constitution described above is mounted on the roof of a mobile like a car and the like, and the antenna board member 13 is rotated by the motor 5 with the movement of the mobile to adjust the orientation to a geostationary satellite.

Since the mobile satellite communication antenna according to the present invention has the antenna board 11 provided on the top surface of the rotary member 10 in the state in which a part of the antenna board 11 protrudes outward in the radial direction from the outer periphery of the rotary member 10, the antenna board 11 doubles as a member for preventing the belt 14 from coming off and reduces the number of parts, which can provide an antenna which is inexpensive and compact and is easily assembled.

Further, since the rotary member 10 is formed of aluminum die cast, the expansion or shrinkage of the rotary member 10 caused by a change in environmental temperature is extremely small in comparison with the conventional rotary member made of resin and hence the antenna board member 13 can provide an antenna which can keep a normal rotation for a long time and has a long life with little trouble.

What is claimed is:

1. A mobile satellite communication antenna comprising:

a disk-like antenna board including a plurality of antenna elements;

a ring-like rotary member provided with the antenna board fixed thereto as an upper lid, wherein the rotary member includes a gear part at its outer circumferential surface, having an annular protrusion protruded from the outer circumferential surface in a radial outward direction below an outer circumferential surface formed at the gear part, and the antenna board having its circumferential end edge protruded from the outer circumferential surface formed at the gear part in the radial outward direction;

a flat plate holding the rotary member rotatably, wherein the flat plate includes a plurality of pulleys spaced apart by a predetermined distance in a circumferential direction of the rotary member and rotatable arranged, the annular protrusion of the rotary member engaged with grooves of the pulleys and rotatably holding the rotary member;

a drive gear arranged at the flat plate; and a toothed endless belt wound around the gear part of the rotary member and the drive gear for rotating the rotary member and the antenna board, wherein the belt is prevented from coming off of the circumferential end edge of the antenna board and the annular protrusion of the rotary member.

2. The mobile satellite communication antenna according to claim 1, wherein the rotary member is made of aluminum die casting.

3. The mobile satellite communication antenna according to claim 1, wherein the motor for rotatably driving the drive gear is installed at the flat plate.

4. The mobile satellite communication antenna according to claim 1, wherein the antenna board has a plurality of antenna elements arranged in a concentric manner.

5. The mobile satellite communication antenna according to claim 1, wherein a lever for preventing looseness of the belt is rotatably biased by a spring against the plate and abutted against the belt.

6. The mobile satellite communication antenna according to claim 1, wherein the antenna board is a single disk-like piece.

* * * * *

UNITED STATES PATENT AND TRADEMARK OFFICE

CERTIFICATE OF CORRECTION

PATENT NO. : 6,172,653 B1
DATED : January 9, 2001
INVENTOR(S) : Tadaaki Ohnishi et al.

It is certified that error appears in the above-identified patent and that said Letters Patent is hereby corrected as shown below:

Claim 1,
Line 17, change "rotatable" to -- rotatably --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*